United States Patent [19]

Vilaseca et al.

[11] 4,448,329

[45] May 15, 1984

[54] DISPENSER FOR TUBES OF FLUENT MATERIAL

[76] Inventors: Hilario S. Vilaseca, Avinguda Joan Prim, 202 Granollers (Barcelona); Ramon B. Mas, Avinguda Joan Prim, 221 Granollers (Barcelona), both of Spain

[21] Appl. No.: 326,901

[22] Filed: Dec. 2, 1981

[30] Foreign Application Priority Data

Dec. 9, 1980 [ES] Spain ..... 255.283
Oct. 21, 1981 [ES] Spain ..... 260.892

[51] Int. Cl.[3] ..... B65D 35/28
[52] U.S. Cl. ..... 222/96; 222/103
[58] Field of Search ..... 222/92, 95, 96, 103, 222/106

[56] References Cited

U.S. PATENT DOCUMENTS

| | | | |
|---|---|---|---|
| 2,053,697 | 9/1936 | Cassanos et al. | 222/103 |
| 2,570,755 | 10/1951 | Booth | 222/96 |
| 3,257,039 | 6/1966 | Trutza | 222/96 X |
| 4,271,985 | 6/1981 | Anderson | 222/96 |

*Primary Examiner*—Joseph J. Rolla
*Assistant Examiner*—Thomas C. Fitzgerald
*Attorney, Agent, or Firm*—Steinberg & Raskin

[57] ABSTRACT

A dispenser for tubes of fluent materials, such as toothpaste, wherein the tube is placed between two wings which are progressively moved towards each other to squeeze the tube and dispense its contents. The wings are mounted at their ends which are remote from the open end of the tube and are movable towards each other by two guides mounted on a carriage which is movable from the mounted ends of the wings towards the open end of the tube. As the carriage moves from the mounted ends of the wings, where the wings are close to each other, towards their other ends, where the wings are initially further apart, the wings are forced together to apply a squeezing force to the tube. The guides are moved by a ratchet system including a reciprocable rack and a ratchet tooth provided on the carriage. Movement of a dispenser operating lever moves the rack in one direction to move the carriage. The ratchet system includes a fixed rack to prevent the carriage from moving in the wrong direction. The operating lever is preferably situated so that an article such, for example, as a toothbrush, pressed against it will have the fluid material, e.g., toothpaste, dispensed directly onto it.

11 Claims, 17 Drawing Figures

FIG. 5
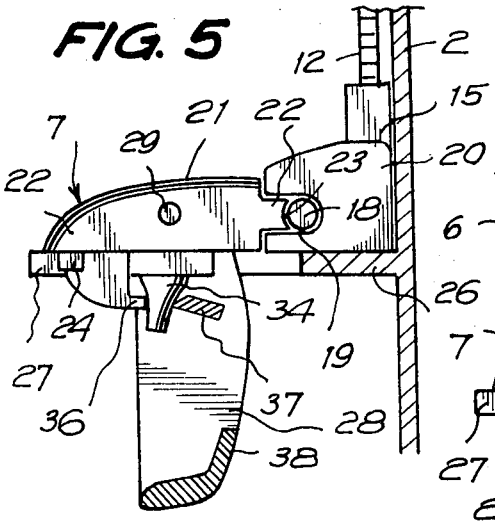
FIG. 6
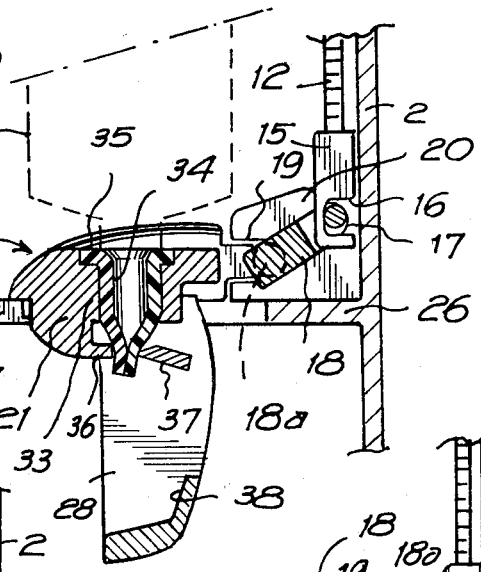
FIG. 7
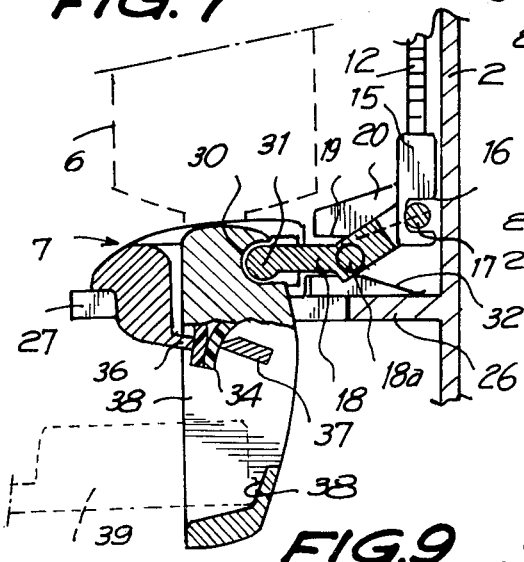
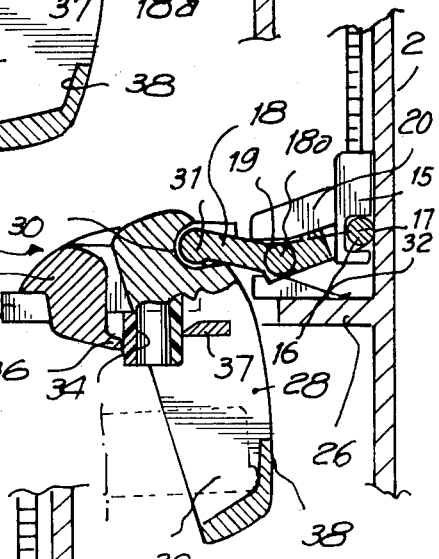
FIG. 8
FIG. 9
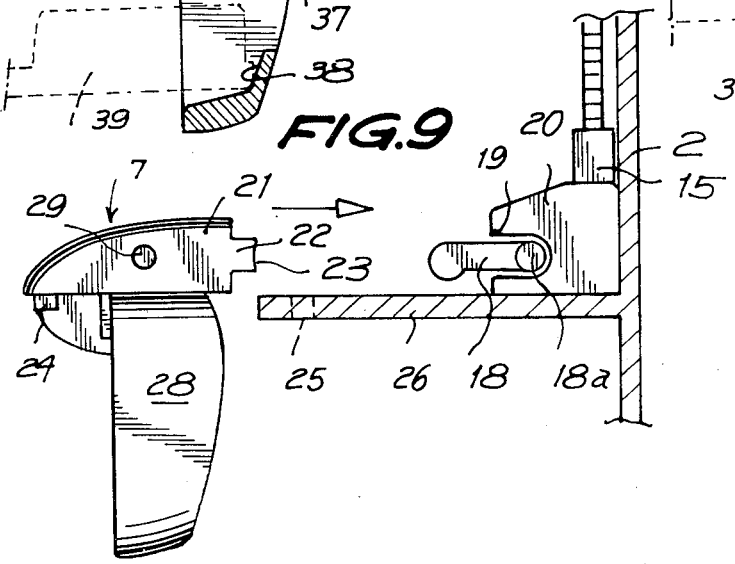

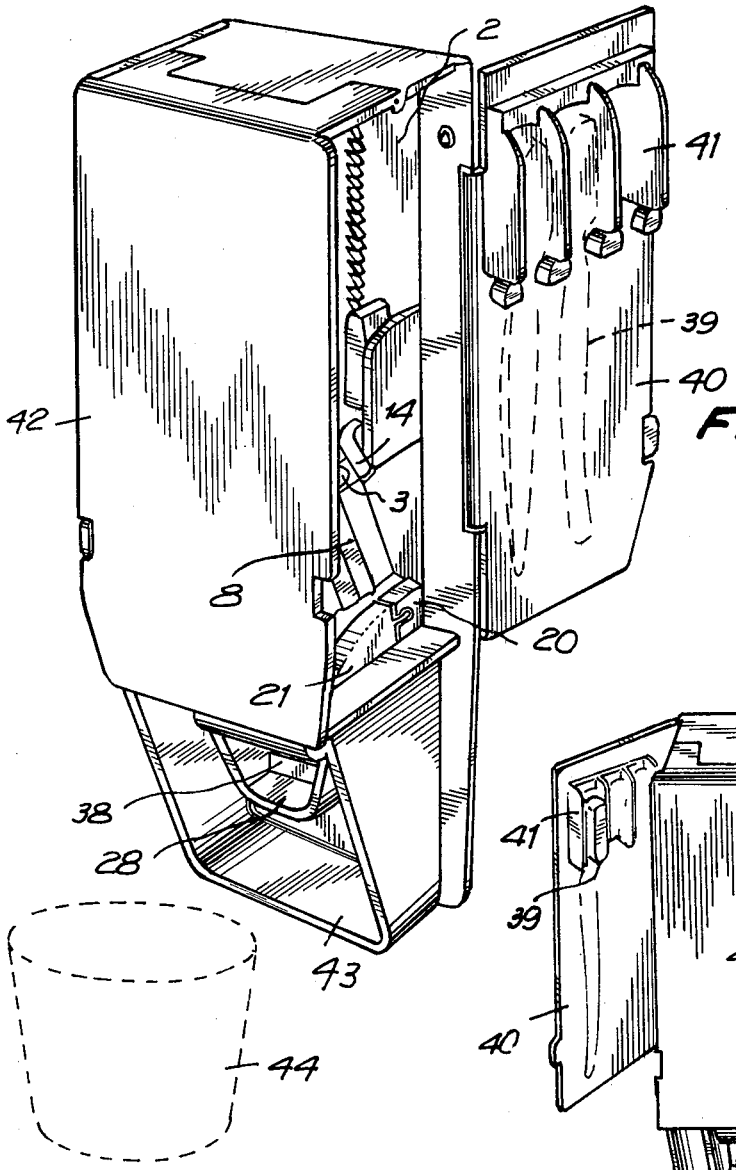
FIG. 10
FIG. 11
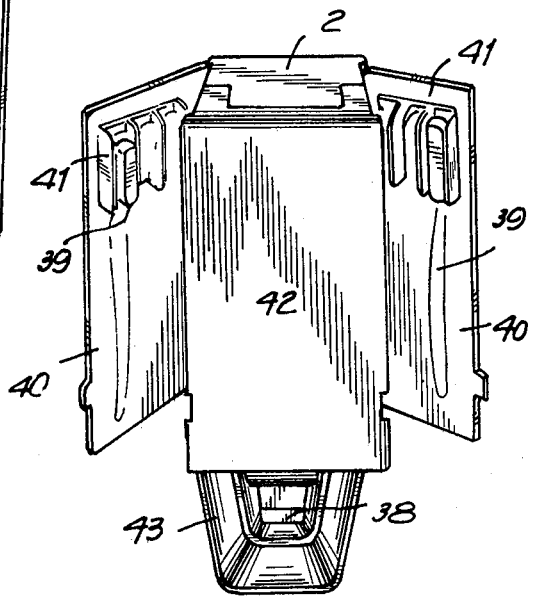

DISPENSER FOR TUBES OF FLUENT MATERIAL

BACKGROUND OF THE INVENTION

2. Field of the Invention

The present invention relates to a dispenser for toothpaste and the like from a tube. According to the invention there may be provided a dispenser suitable for accommodation in a cabinet containing means for the storage of utensils required for dental hygiene, such as toothbrushes and a glass.

The present invention relates to dispensers which may be used for tubes of fluent materials other than toothpaste, but for the sake of simplicity and ease of understanding it will be described with reference to toothpaste tubes.

The use of tubes of toothpaste for cleaning teeth is not usually particularly hygienic. Also, it is difficult to get the whole contents out of the tube.

SUMMARY OF THE INVENTION

Although automatic supply devices which attempt to solve the problems posed are known, they are complex and expensive to produce. The present invention results from an attempt to overcome the drawbacks of the prior art, and provides, in some embodiments at least, a device with the aid of which controlled dispensing is achieved under satisfactory hygienic conditions, while a solution is provided to the problem entailed by the hardening of some toothpastes in the outlet nozzle of the dispenser and the resulting clogging of the outlet.

The present invention provides a dispenser for tubes of fluent materials having means for supporting in a dispensing position a compressible tube of fluent material open at one end, two wings extending along the length of and either side of the tube when present and in the dispensing position, the respective ends of the wings away from the open end of the tube being mounted so that the wings are movable towards each other so as to squeeze between them the tube in the dispensing position and thereby express its contents, two guides, one on each side of the wings, carried on a carriage which is movable to move the guides along the wings away from the said mounted ends so as to urge the wings towards each other, and a ratchet mechanism operable to produce the said movement of the carriage in steps.

Preferably the dispenser outlet is closed except during the dispensing operation. When the tube is empty, the wings are as close together as the guides can get them and the carriage and guides have moved as far away from the joined ends of the wings as they travel. The dispenser can be reloaded by moving the carriage back towards the joined ends of the wings (the ratchet may have to be released for this reloading), allowing the wings to be opened out and the old tube to be exchanged for a new one.

The carriage may carry a movable ratchet tooth which bears resiliently against a ratchet rack, which is axially slidable in reciprocating movements and which is in turn operated by a lever device. Conveniently, force may be applied to the lever by the toothbrush onto which the toothpaste is to be dispensed.

In one embodiment the carriage which compresses the hinged wings has two movable teeth resiliently pressed against respective racks, one of which racks is movable and effects the progressive displacement of the carriage, while the other is fixed and prevents its backward movement. Each tooth has an extension to facilitate its manipulation for the purpose of releasing the carriage.

The movable rack can be operated by a lever pivoted on a part of the tube support which carries a seat for the outlet mouth at the open end of the tube, which lever also bears pivotally on a rocker the other end of which is pivotally connected to the rack. Movement of the lever rocks the rocker, which in turn moves the rack. The lever may also incorporate a part which closes the toothpaste outlet nozzle when the device is in its rest position.

The outlet nozzle is preferably in the form of a flexible tube situated near a projection on the lever support, while the lever also has a projection and the tube is squashed flat and thereby closed, between the two projections when the lever is in its rest position.

The flexible tube advantageously has a collar which forms a leakproof seat for the end of the toothpaste tube.

Preferably the assembly formed by the lever and the support carrying the seat for the end of the toothpaste tube can be removed from the cabinet in which the device is mounted, for which purpose the support may carry means for engagement with support walls or arms solid with the cabinet, and small arms whose ends are shaped as half-bearings and fit into slots having rounded ends which also hold the ends of the rocker pivot pin, so that the ends of the arms and the ends of the slots form jointly the bearing for the rocker pivot pin. The lever itself may have bearing-like cavities which receive one end of the rocker.

In another embodiment the wings may be flexible and be pressed against the opposite sides of the tube by means of guides in the form of at least one pair of rollers whose axes extend transversely in relation to the longitudinal axis of the tube and which are mounted on the movable carriage and are freely displaceable in an oblique direction in relation to the longitudinal axis of the tube, so as to adopt two opposite positions: a working position in which they tend to come close to each other and bear upon the wings and a position of disengagement in which they are spaced further apart and bear less strongly, if at all, on the wings.

In this embodiment the carriage may have two pairs of lateral springs, formed by respective resilient clips pivoted on pins mounted on the carriage. One of the ends or teeth of each clip is pressed resiliently against the toothed edge of a slidable double rack operated by a corresponding system of levers so as to perform axial reciprocating movements. The other tooth of each clip is supported resiliently against fixed racks situated on both sides of the movable double rack.

The flexible wings may be urged elastically, by their hinged ends, by means of a band or leaf spring in the same direction as that of the advancing movements of the carriage.

The flexible toothpaste outlet nozzle may have a cup-shaped extension provided with an internal rim fitting sealingly under pressure around the threaded neck of the tube.

The dispensing device is advantageously housed inside a cabinet equipped with two independently opening side doors and with means for storing brushes and any other accessories which can be used for cleaning teeth, while at the front the device has a door giving access to the mechanism and to the tube; this door may leave the lever operating the device exposed even when closed.

In the cabinet a compartment may optionally be provided to contain the operating lever and the outlet nozzle, with space for holding a glass and optionally a separate door.

BRIEF DESCRIPTION OF THE DRAWINGS

Embodiments of the present invention, given by way of example only, will now be described with reference to the accompanying drawings, in which:

FIG. 5 is a side view in elevation of the assembly forming part of the dispenser of FIG. 1, composed of the operating lever and its support joined to the cabinet, the lever being shown in section;

FIGS. 6 and 7 are respective sectional views on the lines VI and VII in FIG. 4, showing the tubular outlet nozzle in the closed position and the lever in the position of rest;

FIG. 8 is a similar view to FIG. 7, but with the mechanism in the working position, with the lever in movement and the tubular nozzle open;

FIG. 9 is a side view in elevation of the assembly of FIG. 5 comprising the lever and the support separated from the cabinet;

FIG. 10 is a view in perspective of the cabinet of FIG. 1, with one side door open;

FIG. 11 is a front view in perspective of the cabinet of FIG. 1 with both side doors open;

DESCRIPTION OF THE PREFERRED EMBODIMENTS

Figure 1:
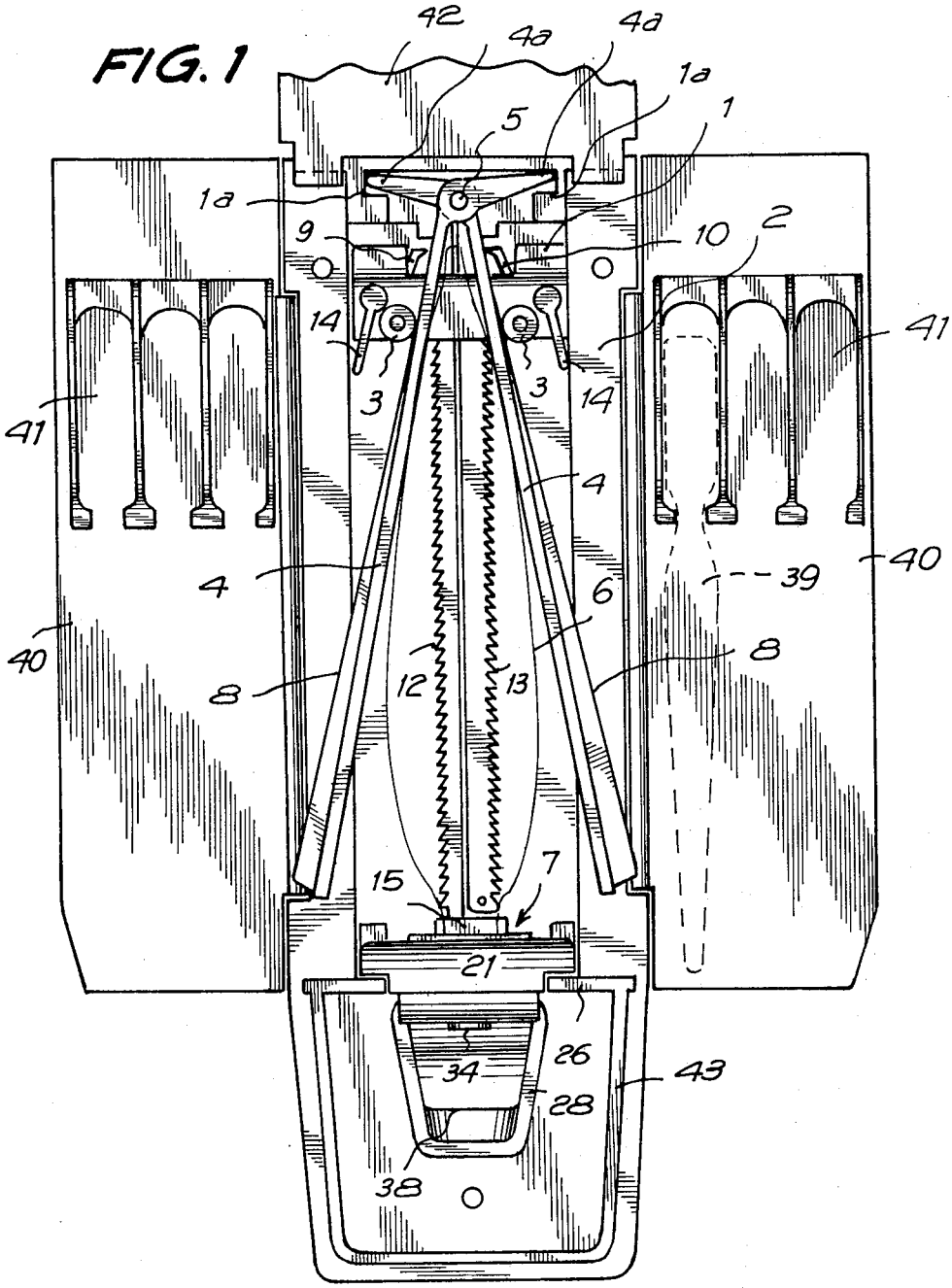
FIG. 1 is a front view in elevation of a dispenser embodying the present invention with the cabinet open with a single movable rack and another one which is fixed.
Figure 2:
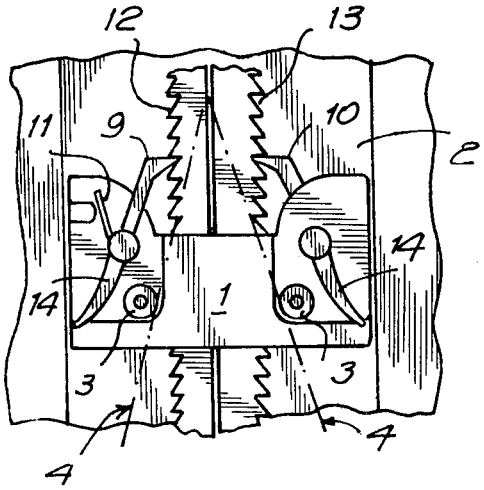
FIG. 2 shows a detail, on a larger scale, of the displaceable carriage of the dispenser of FIG. 1 which acts on the pivoted wings, which have been shown in broken lines, the carriage having two movable teeth bearing against the racks.
Figure 3:
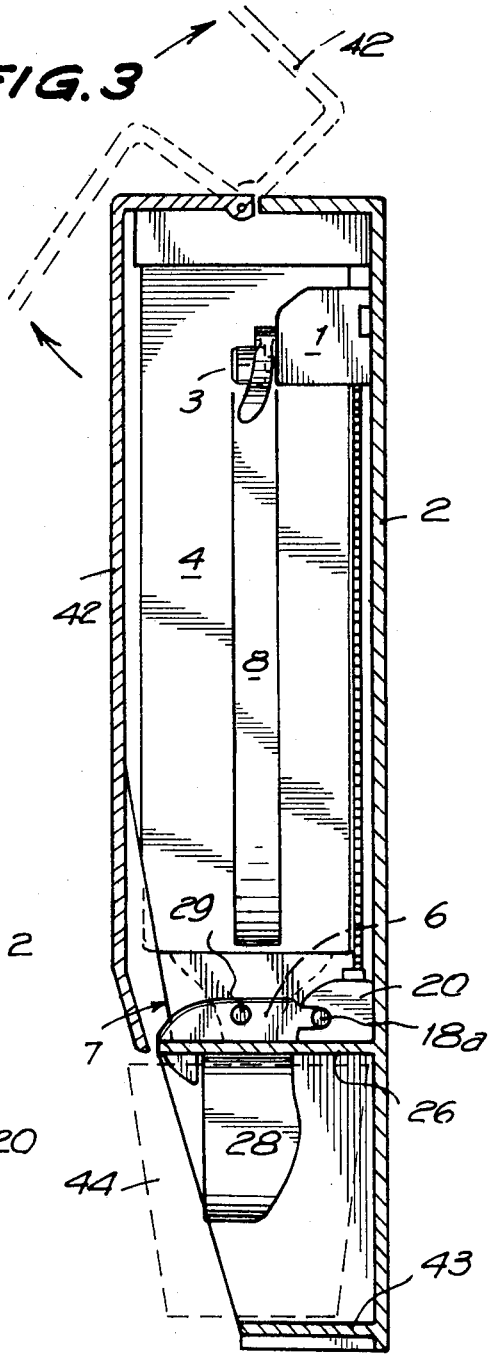
FIG. 3 is a side view in elevation of the dispenser of FIG. 2 inside the cabinet, which is shown in longitudinal section with the front door closed, and broken lines showing part of the front door in two open positions.
Figure 4:
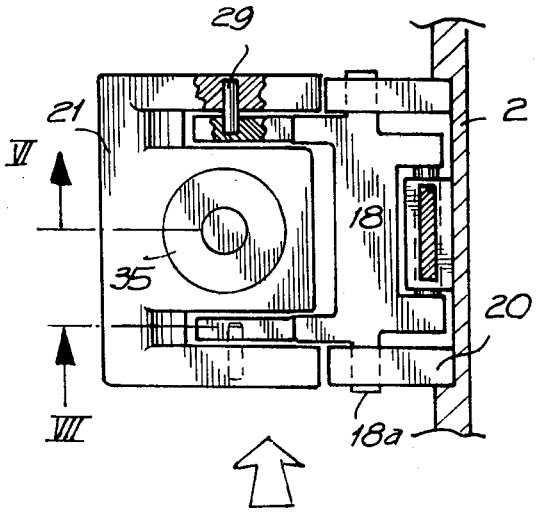
FIG. 4 is a plan view, partly in section showing parts of the dispenser of FIG. 1, viz. the seat for the outlet end of the tube, with the support, the operating lever and the rocker.
Figure 12:
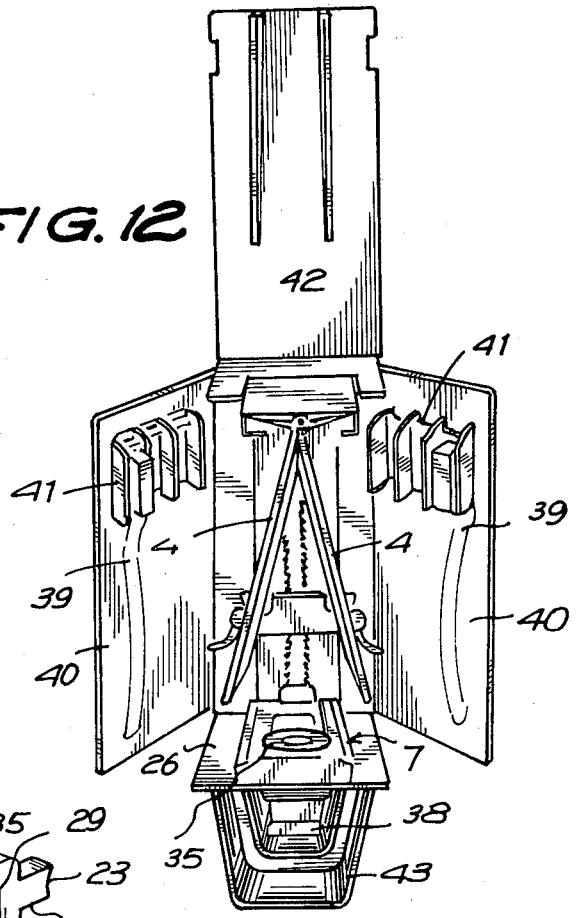
FIG. 12 is a front view in perspective of this cabinet with the side and front doors open.
Figure 12:
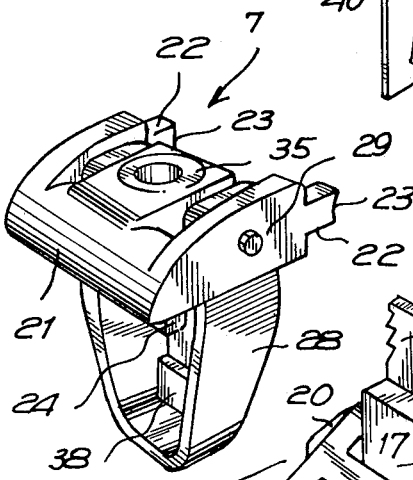

A dispenser for toothpaste and the like embodying the present invention is shown in FIGS. 1 to 13. It has a carriage given the general reference 1, which is displaceable vertically in the interior of a cabinet 2, this carriage holding guides 3, which are suitably spaced and which bear against two wings 4 hinged together at one end 5 to form a dihedral angle, tending to force them together. A toothpaste tube 6 is placed between the wings 4 (FIG. 1) with its outlet nozzle supported on a support base given the general reference 7, and as the wings 4 are forced together they compress the tube 6. The wings 4 have on their outer faces longitudinal tracks 8 in the form of ramps which increase in height towards the opposite end to that where the hinge 5 is provided, the guides 3 bearing against these tracks.

The wings 4 are supported by arms 4*a* (FIG. 1) which are trapped in recesses 1*a* in the top of the cabinet 2. The joint 5 is displaced vertically downwardly as the wings 4 close.

The carriage 1 carries two movable ratchet teeth 9 and 10 in opposed positions, which are urged by respective springs 11 (FIG. 2) against respective ratchet racks 12 and 13. The teeth 9 and 10 have arms 14 to form handles for manual operation.

The rack 12 is displaceable by reciprocating axial movements, as will be explained in detail further on, and the rack 13 is fixed with respect to the cabinet 2.

At its bottom end the rack 12 has a thicker portion 15 with a socket 16 which holds pivotally one end 17 of a rocker 18, which rocker is also pivoted on a central pin 18*a* in notches 19 provided in respective lugs 20 which project from the bottom of the cabinet 2 (FIGS. 5 and 6).

Figure 13:
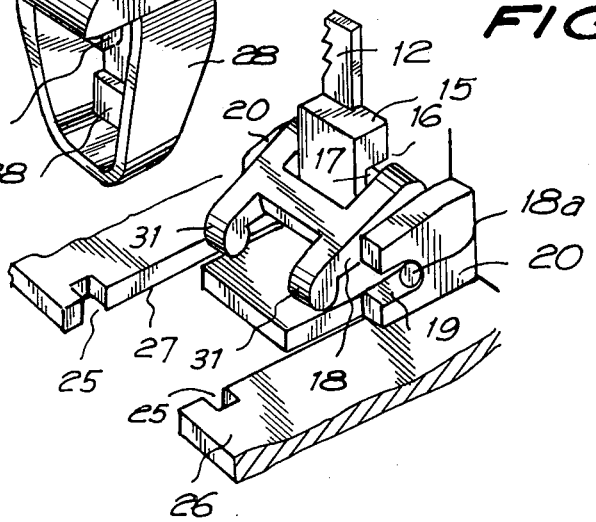
FIG. 13 shows a detail in perspective, showing the assembly of FIG. 5 comprising the lever and its support, separated from the cabinet.
Figure 14:
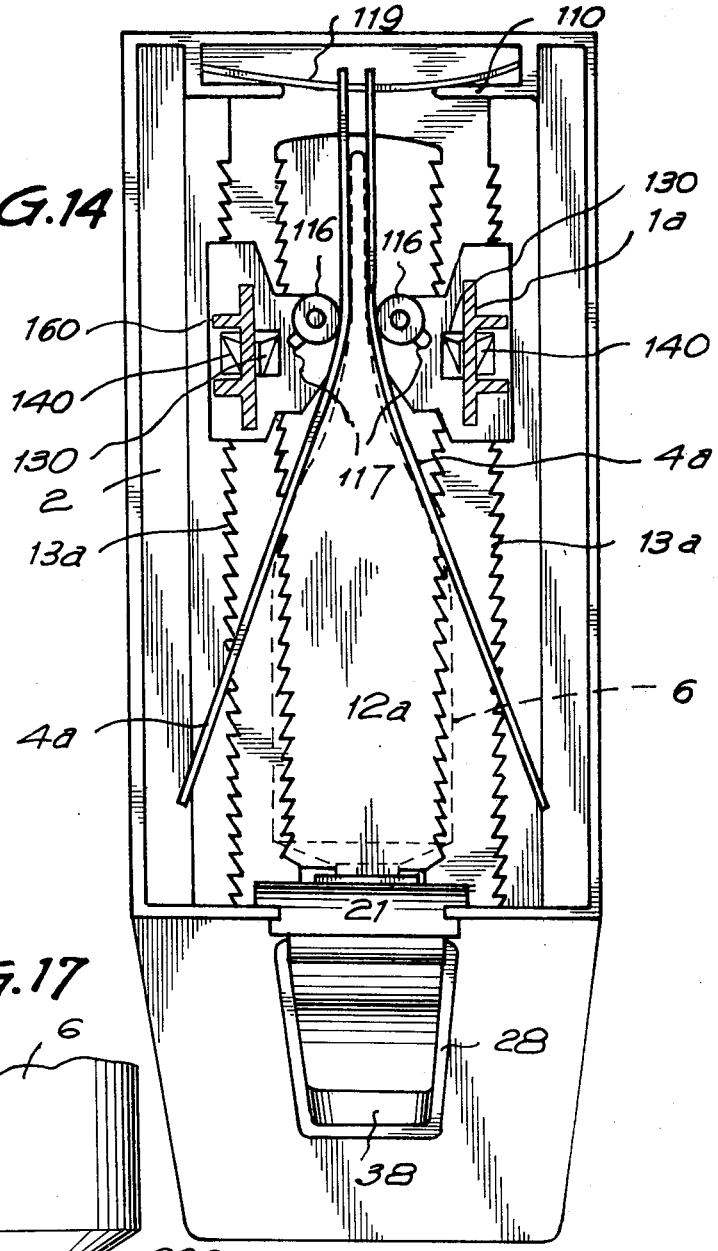
FIG. 14 is a front view in elevation of a second embodiment of the invention having flexible wings in which the toothed roller carriage is shown in longitudinal section.

The removable assembly 7 consists of a support 21 equipped with two projecting studs 22, whose ends 23 are curved and which fit into the notches 19, thus securing the ends of the pin 18*a*. The support 21 is in addition equipped with two teeth or projections 24, which fit into respective notches 25 provided in a platform 26, which has an opening 27 permitting the passage of a lever 28 pivoted to a pin 29 held by the member 21 (FIG. 13).

The lever 28 has a bearing-like cavity 30 (FIG. 7) receiving the other (rounded) end 31 of the rocker 18 from the end 17. The assembly formed by the lever 28 and the rocker 18 is held in a stable position by the action of a spring 32 (FIG. 7) acting on the rocker.

The member 21 is provided with an aperture 33 into which is fitted a flexible tube or nozzle 34, which has a radial external collar 35 constituting the seat for the support of the outlet end of the toothpaste tube 6. The nozzle 34 projects at the bottom from the member 21 adjacent a flange-like projection 36 integral with the support 21. The lever 28 in turn is provided with an arm 37 lying opposite the flange 36, in such a manner that the nozzle 34 is squeezed closed between the flange 36 and the arm 37 when the lever 28 is in its rest position, (FIGS. 6 and 7).

The lever 28 is hollow and open front and back and has a seat 38 intended to support a toothbrush 39, by means of which it is operated (FIGS. 7 and 8).

The cabinet 2 is provided with two side doors 40, the interiors of which are equipped with receptacles 41 for suspending toothbrushes 39.

At the front the cabinet 2 is provided with a door 42, which need only be opened to replace the toothpaste tube 6 or for removing the assembly 7.

In the bottom part of the cabinet 2 an enclosure 43 is provided, which surrounds the space occupied by the assembly 7, and in which a glass 44 can be kept. This enclosure 43 may be provided with a door separate from the door 42.

The operation of the toothpaste dispenser which has been described and illustrated in FIGS. 1 to 13 is as follows:

The toothpaste tube 6 is first placed in the inverted position with its mouth supported on the collar 35, which fits hermetically, and the carriage 1 is situated at the top of its path along the racks 12 and 13, its position being adjusted in accordance with the size of the tube, in such a manner that the guides 3 of the carriage hold the wings 4 pressed against the walls of the tube. The cap of the toothpaste tube will have been removed, the tube being kept closed by the compressive action of the arm 37, which squeezes the nozzle 34 against the flange 36 (FIGS. 6 and 7).

In order to dispense an amount of toothpaste onto a toothbrush, the brush is inserted into the lever 28 and pressed against the seat 38, pushing back the lever. As it is moved, the lever 28 transmits its movement to the rocker 18, which is displaced angularly about pin 18*a*, against the tension of the spring 32, moving the rack 12 downwards, the rack being connected to the rocker through the parts 17, 16 and 15. The downward displacement of the rack 12 is transmitted to the carriage 1 through the tooth 9. When the carriage is displaced, the guides 3 force the wings 4 together, acting on the ramps 8, and compressing the tube. This expels a small dose of toothpaste through the nozzle 34, which was opened when the flange 37 was moved away from the arm 36 (FIG. 8). The tooth 10 will move down the fixed rack 13 as the carriage 1 moves down.

When the pressure on the lever 28 is terminated, the lever returns to its original position under the action of the spring 32 on the rocker 18. The rocker carries with it the rack 12, which slips over the tooth 9 in the normal manner of ratchets, overcoming the action of the springs 11. The tube 34 is automatically closed through the pinching action of the flange 37 and arm 36.

The tooth 10 and the fixed rack 13 are particularly needed when the carriage is near the top of the wings 4 because the separating action applied by the tube 6 through the wings 4 acts on the carriage 1 to move it back in the upward direction.

As the wings 4 are closed through the action of the carriage as the latter moves downwards, the arms 4*a* bring about a downward movement of the hinge 5 and consequently of the wings, which, in addition to the lateral pressure against the toothpaste tube, apply a downward pressure which causes the tube to be held firmly against the washer 35.

The assembly 7 can be dismantled for periodic cleaning. It is also important to stress that the toothpaste tube remains hermetically closed by fitting against the washer 35 and by the pinching action applied by the flange 37 and the arm 36.

For the purpose of utilising the mechanisms it is not necessary to open the doors of the cabinet, provided that the lever 28 is accessible. A small door (not shown in the drawings) may be provided for the enclosure 43 to protect the lever mechanism.

The side doors permit access to the brushes, while the front door allows the tube to be exposed for replacement.

When it is necessary to replace the tube, the carriage 1 must be moved back to its top position, for which purpose use is made of the unlocking levers 14, which disengage the teeth 9 and 10 from the ratchets 12 and 13.

FIGS. 14 to 17 show a different embodiment. The same reference numbers are used for corresponding parts, which will not be fully described again. In a cabinet 2 are two fixed ratchet racks 13*a* and one movable double ratchet rack 12*a* operated by the lever 28.

Between the fixed racks 13*a* and the movable rack 12*a* is mounted a slidable carriage 1*a* carrying two guides in the form of rollers 116, whose axles are mounted in elongated openings 117, which tend to converge towards the centre of the carriage at their upper ends. These rollers are supported against flexible wings 4*a* connected at the top to a spring or band 119 housed in a compartment 110 in the cabinet 2. The wings 4*a* urged towards each other by the rollers 116 against opposite sides of the tube 6 whose contents are to be dispensed.

On the carriage 1*a* are mounted two resilient U clips 120 (FIG. 16), whose ends form respective teeth 130 and 140. These clips 120 are pivoted on respective pins 150 mounted in each case on one of their arms and supported by lateral flanges 160 formed on the carriage 1*a* and provided with notches 170.

Figure 17:
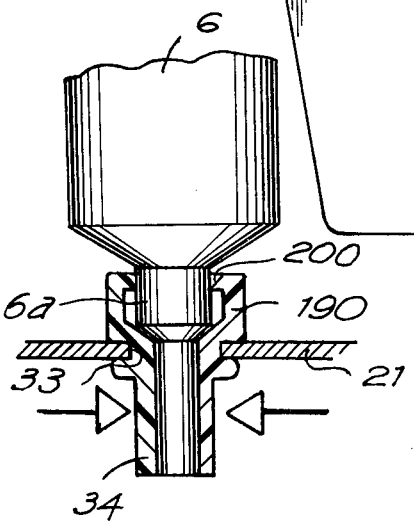
FIG. 17 shows the outlet nozzle of the dispenser of FIG. 14 with the neck of the tube fitted under pressure in it.
Figure 15:
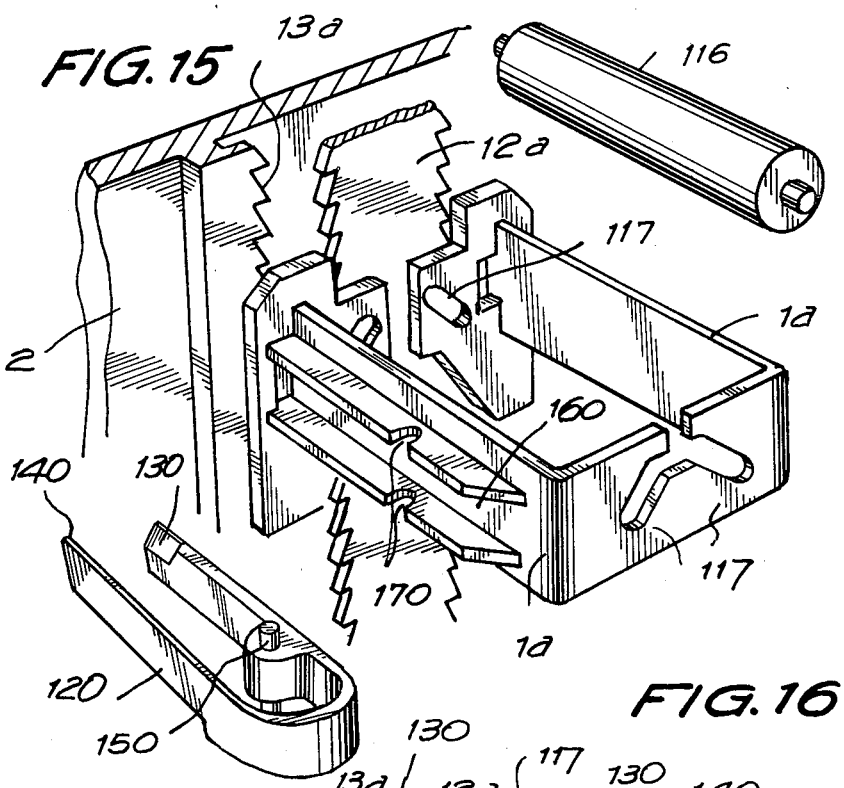
FIG. 15 shows in perspective a detail of the carriage of FIG. 14, with one roller and one resilient clip separated from it.
Figure 16:
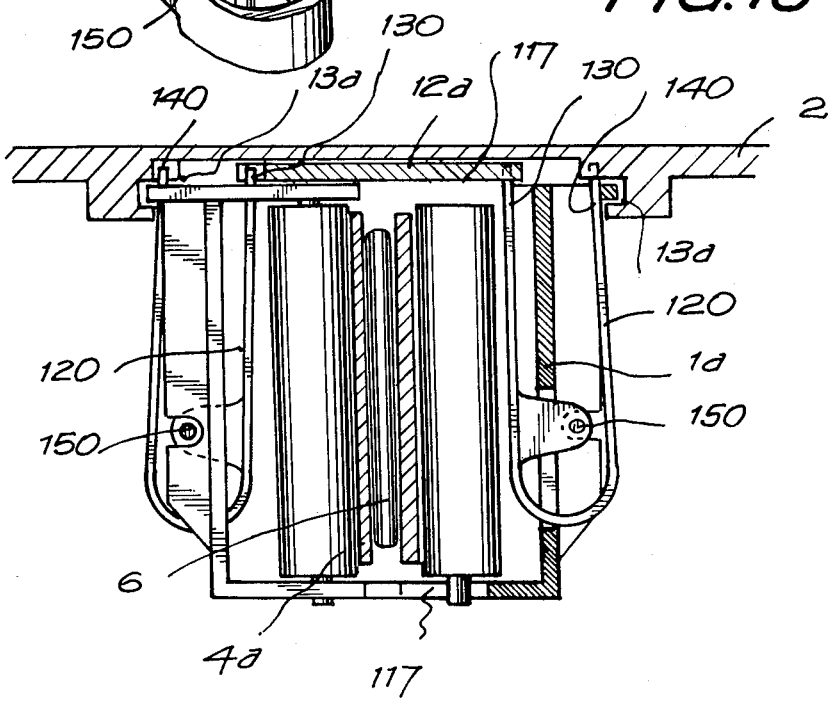
FIG. 16 is a plan view, partly in section of the carriage of FIG. 14 with the two rollers and the two clips fitted in it.

In the bottom part of the cabinet 2 is mounted a resilient outlet nozzle 34 (FIG. 17), which has a widening 190 provided with an internal annular flange 200 which fits sealingly around and presses against the threaded neck 6*a* of the tube 6 (FIG. 17).

The mechanism and operation of this embodiment are similar to those of the embodiment of FIGS. 1 to 13.

The downward movement of the carriage tends to displace the rollers 116 in an upwardly converging direction because of the angle of the slots 117.

In order to return the carriage 1*a* to its starting position it is necessary to press together the arms of the clips 120, whereupon the ends 130 and 140 of the clips are freed from the teeth of the respective racks 13*a* and 12*a*.

When the carriage 1*a* is pushed in the upward direction, the rollers 116 are displaced downward and outward in the inclined slots 117, thus being moved away from the wings 4*a* and facilitating the free return of the carriage for the purpose of changing the tube.

The spring 119 pushes the tube against the nozzle 190, thus ensuring hermetic closure of the latter around the neck 6*a*. This nozzle 190 permits the universal fitting of tubes of different diameters.

What is claimed is:

1. A dispenser for tubes of fluent materials, comprising:

means for supporting a compressible tube of fluent material which is open at one end in a dispensing position, two flexible wings extending along the length of and on either side of the tube when the latter is present and supported in the dispensing position, the respective ends of the wings distal from the open end of the tube being mounted so that the wings are movable towards each other so as to squeeze between them the tube in the dispensing position and thereby express its contents, two guides, each guide being positioned on a side of a respective one of the wings, a carriage on which the guides are mounted, said carriage being movable to move the guides along the wings away from the mounted ends thereof so as to urge the wings towards each other, the guides being mounted on the carriage such that each of said guides is free to move relative to the carriage in an oblique direction relative to the length of a tube when the latter is present in the dispensing position, the guides being so movable in directions approaching each other as they move towards the mounted ends of the wings and away from the open end of a tube present in the dispensing position, and a ratchet mechanism operable to produce the said movement of the carriage in steps.

2. A dispenser according to claim 1 in which the said mounted ends of the wings are mounted on a spring which urges them in the direction of the open end of the tube.

3. A dispenser according to claim 1 in which the ratchet mechanism includes two ratchet racks integral with each other and axially reciprocable so as to produce said movement of the carriage, and two fixed ratchet racks and four ratchet teeth on the carriage each rack engaging a respective ratchet tooth.

4. A dispenser according to claim 1 in which the said guides are rollers.

5. A dispenser according to claim 1 in which the tube support means includes a dispensing nozzle against which the open end of the tube seats with a hermetic seal in the dispensing position, the dispensing nozzle having a flexible collar which seals around the open end of a tube seated against the nozzle.

6. A dispenser according to claim 1 in which the ratchet mechanism includes a ratchet tooth on the carriage and a ratchet rack engaging the ratchet tooth, which rack is axially reciprocable so as to produce the said movement of the carriage.

7. A dispenser according to claim 6 further having a lever and a return spring, the rack being arranged to be moved in one direction of its reciprocation by the action of external force on the lever and in the other direction by the return spring, the action of the spring also returning the lever to its rest position, the lever being so disposed that an article may be pressed against it to apply the said external force and the dispenser will dispense onto that article.

8. A dispenser according to claim 7 further having a rocker, movement of the lever rocking the rocker which in turn moves the rack, and the return spring acting on the rocker.

9. A dispenser according to claim 8 in which the ratchet mechanism also includes a second ratchet tooth on the carriage and a second, fixed, ratchet rack engaging the second ratchet tooth.

10. A dispenser according to claim 9 in which the contents of a tube in the dispensing position are prevented from coming into contact with the atmosphere while dispensing is not taking place.

11. A dispenser according to claim 10 in which the support means includes a dispensing nozzle against which the open end of a tube seats with a hermetic seal in the dispensing position, the dispensing nozzle including a flexible tube portion, the dispenser further having means mounted on the lever which squash the flexible tube portion so as to close it and prevent the contents of a tube in the dispensing position from coming into contact with the atmosphere when dispensing is not taking place.

* * * * *